United States Patent [19]

Sawada et al.

[11] Patent Number: 5,050,852

[45] Date of Patent: Sep. 24, 1991

[54] BLANK FEEDER AND METHOD FOR CONTROLLING THE SAME

[75] Inventors: Tetsuya Sawada; Hidetoshi Hoshiyama; Ikuo Yoshimoto; Shinichi Sogo, all of Osaka, Japan

[73] Assignee: Rengo Co. Ltd., Osaka, Japan

[21] Appl. No.: 569,795

[22] Filed: Aug. 17, 1990

[30] Foreign Application Priority Data

Aug. 23, 1989 [JP] Japan ..... 1-217151
Oct. 3, 1989 [JP] Japan ..... 1-259713

[51] Int. Cl.[5] ..... B65H 5/08

[52] U.S. Cl. ..... 271/11; 271/99; 271/112; 271/114; 271/116; 271/270; 271/137; 271/139; 414/797.7; 414/797.9

[58] Field of Search ..... 271/11, 14, 99, 112, 271/114, 115, 116, 202, 270, 130, 137, 139; 414/797.7, 797.9

[56] References Cited

U.S. PATENT DOCUMENTS

| | | | |
|---|---|---|---|
| 3,173,682 | 3/1965 | Shields | 271/139 |
| 4,494,745 | 1/1985 | Ward, Sr. et al. | 271/99 X |
| 4,519,601 | 5/1985 | Watanabe | 271/114 |
| 4,630,812 | 12/1986 | Yano et al. | 271/99 X |
| 4,632,381 | 12/1986 | Cair et al. | 271/270 |
| 4,889,331 | 12/1989 | Sardella | 271/112 X |
| 4,896,872 | 1/1990 | Sardella | 271/112 X |

FOREIGN PATENT DOCUMENTS

| | | | |
|---|---|---|---|
| 32185 | 5/1962 | Finland | 414/797.7 |
| 0047243 | 2/1988 | Japan | 271/137 |

*Primary Examiner*—H. Grant Skaggs
*Assistant Examiner*—C. Druzbick
*Attorney, Agent, or Firm*—Armstrong, Nikaido, Marmelstein, Kubovcik & Murray

[57] ABSTRACT

A blank feeder for feeding blanks. It has a feed table on which a plurality of blanks are stacked, a suction unit provided under the table to suck the lowermost one of the stack downward, a motor-driven first feed rolls mounted in the suction unit and adapted to feed the lowermost blank in contact therewith, and second feed rolls located downstream of the first feed rolls and adapted to be driven at a constant speed. The first feed rolls are accelerated from zero speed to the speed of the second feed rolls before the front end of the blank reaches the second rolls, then driven synchronized with the second feed rolls, and decelerated to zero speed again by the time the next cycle begins. A kicker for pushing out the blank may be provided. The kicker is moved forward so as to be synchronized with the second feed rolls before the front end of the blank reaches the second feed rolls. Once synchronized, this state is maintained until the rear end of the blank gets off from the kicker.

3 Claims, 6 Drawing Sheets

BLANK FEEDER AND METHOD FOR CONTROLLING THE SAME

This invention relates to a blank feeder for feeding blanks such as corrugated fiberboards cut to a predetermined size to a next processing machine such as a printing machine, and to a method for controlling a blank feeder.

Some of the prior art feeders for fiberboard blanks into a printing machine are provided with a kicker assembly. It comprises a kicker adapted to kick the lowermost one of the fiberboard blanks stacked on a table to push it out horizontally, a link located under the table and coupled to the kicker, a pivotable lever pivotally coupled to the link and a rotary disk for pivoting the lever through a crank pin.

The fiberboard blanks are pushed out one by one by the kicker through a gap defined by a guide plate at the front end of the feeder and the table and having such a size as to allow the passage of one blank at a time. The blanks thus pushed out are caught between feed rollers provided downstream and fed into the next processing unit.

One problem experienced by such a feeder with a kicker assembly is that if a blank is bent or warped, the kicker may not touch the entire area of the rear end of the blank but only partially. If the blank is pushed by the kicker in this state against the weight of the blanks stacked thereon, its rear end might be bent or broken. This may prevent the kicker from feeding the blanks reliably. Further, such a blank may get caught when it passes through the gap defined by the table and the guide plate, preventing smooth feeding.

To solve this problem, a blank feeder as shown in FIGS. 8A–8D was proposed (U.S. Pat. No. 4,045,015). This device has a suction unit 03 under a table 02 near a guide plate 01 located at front end of the device to feed fiberboard blanks W in a flat state. Further, first feed rolls 04 are provided in the suction unit 03 to feed the blanks W toward second feed rolls 05 by the frictional torque applied by the rolls 04.

FIG. 8A is a vertical sectional view showing schematically the entire structure of this device. FIG. 8B shows the state where the blank W, fed by the first feed rolls 04, is caught between the second feed rolls 05. FIG. 8C shows the state where the front half of the blank W has passed through the rolls 05. In this state, the rolls 04 have rotated to such a position that their arcuate portions are facing down and thus the blank is not being fed by the rolls 04 any more. FIG. 8D shows the state where the blank has passed almost entirely through the second feed rolls 05 with the arcuate portions of the first feed rolls 04 moving upward for the next feeding step.

Though not shown, the above-described device is provided near the suction unit 03 with a mechanical means for transmitting torque from the second feed rolls 05 or the device in the next step to the first feed rolls 04. Between these two kinds of feed rolls, timing of operations such as acceleration, synchronization, deceleration and stopping is controlled through the mechanical means.

With the prior art blank feeder, it was necessary to provide a mechanical and complicated means between the driving unit for the next step and the first feed rolls to change the rotating conditions of the first feed rolls.

This complicates the structure of the entire device and increase its size. Thus it tends to be costly.

Also, failure to synchronize with the next step such as printing step due to abrasion on the speed change gear might cause defective printing. In such a case, the blanks will have to be wasted.

The blank feeder with a suction unit containing the first feed rolls has a problem that slip tends to occur between the blank and the feed rolls. This makes it difficult to accurately feed the blanks and thus to pass it to the next unit in good timing.

It is an object of the present invention to provide a blank feeder which obviates the abovesaid shortcomings and can feed the blanks smoothly.

In the present invention, the first feed rolls and the second feed rolls (or the next unit) are driven by separate driving means. Even so, it is necessary that they are synchronized with each other in each cycle of actual processing operation. The second feed rolls are rotated at a predetermined constant speed, whereas the driving conditions of the first feed rolls are constantly changing, e.g. among acceleration, synchronization with the second feed rolls, deceleration and stopping.

According to this invention, the blanks stacked on the blank feed table are fed one by one while being accelerated by the first feed rolls. The moment the feed speed of the blank is synchronized with the rotating speed of the second feed rolls after a predetermined time has passed, the blank is caught between the second feed rolls.

Once the blank is caught by the second feed rolls, it is fed at the same speed as the rotating speed of the second feed rolls. The first feed rolls keep turning synchronized with the second feed rolls all the while. When the blank clears the first feed rolls, the latter will be decelerated and then stopped.

While the blank is being fed, the suction unit always pulls it downwards to prevent it from warping or bending. When the feeding step of one blank finishes, the next one is fed by the first feed rolls while keeping a flat state by the suction unit in the same manner as the preceding step.

Other features and objects of the present invention will become apparent from the following description taken with reference to the accompanying drawings, in which.

FIRST EMBODIMENT

Figure 1:
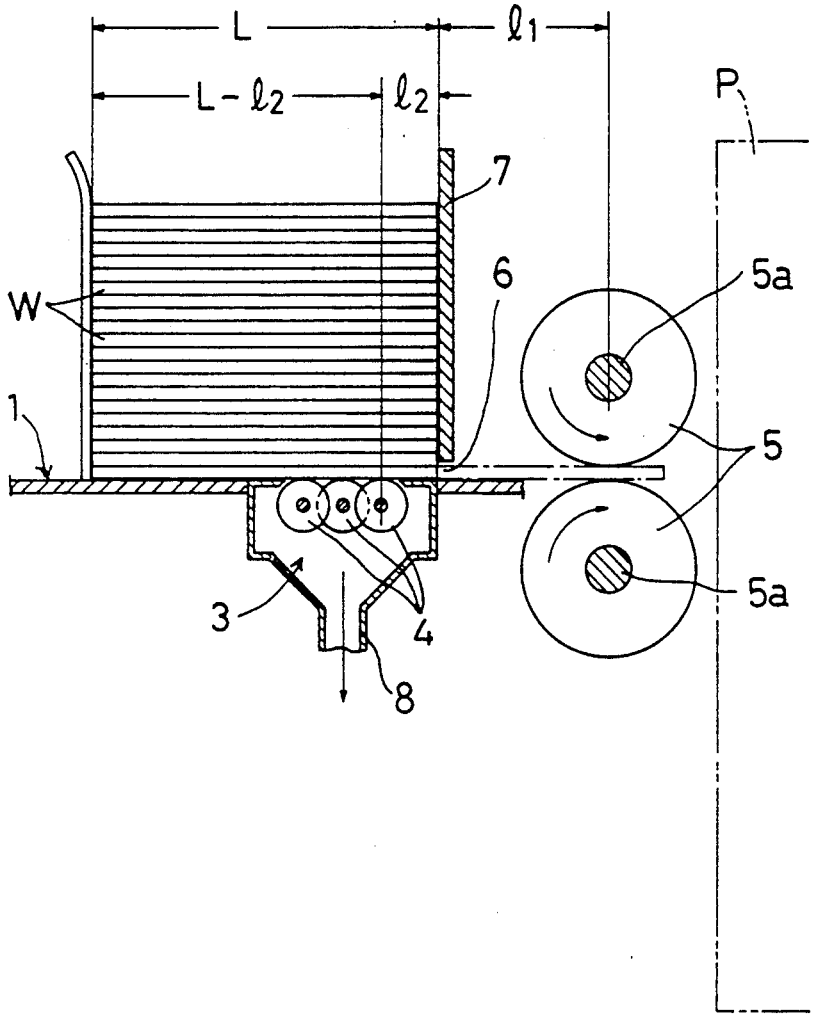
FIG. 1 is a schematic vertical sectional view of the first embodiment.

As shown in FIG. 1, the blank feeder has a blank feed table 1 on which cardboard (such as fiberboard) blanks W are stacked, a suction unit 3 for drawing the lowermost one of the blanks W downward, first feed rolls 4 mounted in the suction unit 3 and adapted to rotate in contact with the blanks W while they are being fed, and second feed rolls 5 for delivering the blanks to a device P for the next step such as printing, cutting, perforating and folding.

A vertical guide plate 7 is provided at the front end of the feed table 1 to define a gap 6 therebetween. The gap is so large that the blanks W can be fed one at a time.

The suction unit 3 is connected to a suction blower (not shown) through a suction pipe 8 to draw the lowermost blank downward and has its top almost fully open. In this embodiment, the first feed rolls 4 are arranged therein in a staggered pattern in three rows.

The second feed rolls 5 comprise rotary shafts connected to a brake, clutch and a motor and circular rolls fixedly mounted on the shafts.

Though not shown, a mechanical coupling is provided between the rotary shafts 5*a* of the second feed rolls 5 and the device P in the next step to drive the second feed rolls 5 synchronized with the device P in the next step.

As shown in the figures, the second feed rolls 5 are located a distance $l_1$ ahead of the guide plate 7 and the first feed rolls 4 are in such a position that the frontmost one is a distance $l_2$ behind the guide plate 7.

The first feed rolls 4 are circular in shape and are driven by a separate motor for the first feed rolls 4 only. Mechanical means for coupling the first feed rolls 4 with the second feed rolls 5 or the device P for the next step is not provided, as in the prior art device.

In the operation of the above-described blank feeder, the motor 33 for the first feed rolls 4 is started to feed the blanks W one by one to the second feed rolls 5 by the frictional torque applied by the first feed rolls 4. While being fed, the blanks W are prevented from being bent because they are drawn downward by the suction unit 3.

The first feed rolls 4 are started by a timing signal given based on an external signal which represents one cycle of the device for the next step.

The feed speed of the first feed rolls 4 has to be increased quickly up to the revolving speed of the second feed rolls 5 before the blank reaches the second feed rolls 5.

Now it will be described how the feed speed of the first feed rolls 4 changes and how their rotation is synchronized with reference to FIG. 3.

As shown in the figure, the first feed rolls 4 are started at time $t_0$. Then their speed is increased as shown by the velocity curve in the figure so as to coincide with the speed of the second feed rolls at time $t_1$ at the latest. Thus the blank W is caught between the second feed rolls 5 and fed to the next step. Therefore, the value obtained by integrating the velocity curve of the first feed rolls 4 by the period of time $t_0$–$t_1$ has to coincide with the distance $l_1$ between the vertical guide plate 7 and the second feed rolls 5.

Next, during the period of time $t_1$–$t_1'$, the first feed rolls 4 and the second feed rolls 5 are driven in perfect synchronization with each other. This is necessary because if the feed rate of the first feed rolls 4 is higher, the blank W might be bent and if lower, it may be torn apart. The blank can not be fed in good timing.

The synchronized period $t_1$–$t_1'$ continues at least until the rear end of the blank clears the frontmost one of the first feed rolls 4. During this period, the blank will move from the distance $l_1$ at time $t_1$ to the distance at $t_1'$ ($L-l_2$) (which corresponds to the time-integrated value of the feed speed curve of the first feed rolls in FIG. 3 between time $t_0$ and time $t_1'$).

Time $t_1'$, when the rear end of the blank W passes the frontmost one of the first feed rolls 4, is detected by an electric control circuit, which is to be described later. The moment the time $t_1'$ , is detected, the one-way clutch 32 is switched OFF and the brake 31 ON to bring the first feed rolls 4 to a sudden stop. The motor 33 is stopped at latest by time $t_4$ when the next cycle starts.

The clutch is turned ON and the brake is released when a timing signal is given at the next starting time $t_4$ ($t_0$) based on an external signal representative of one cycle of the next step. Thus the next step is carried out.

In this embodiment, the blank feed action by the first feed rolls 4 is stopped by use of the one-way clutch and the brake. To achieve the same purpose, the first feed rolls 4 may be lowered at time $t_1'$. Further, as is already known, arcuate first feed rolls may be employed. If the first feed rolls 4 are lowered at time $t_1'$, they have to be raised at time $t_4$ ($t_0$).

Figure 2:
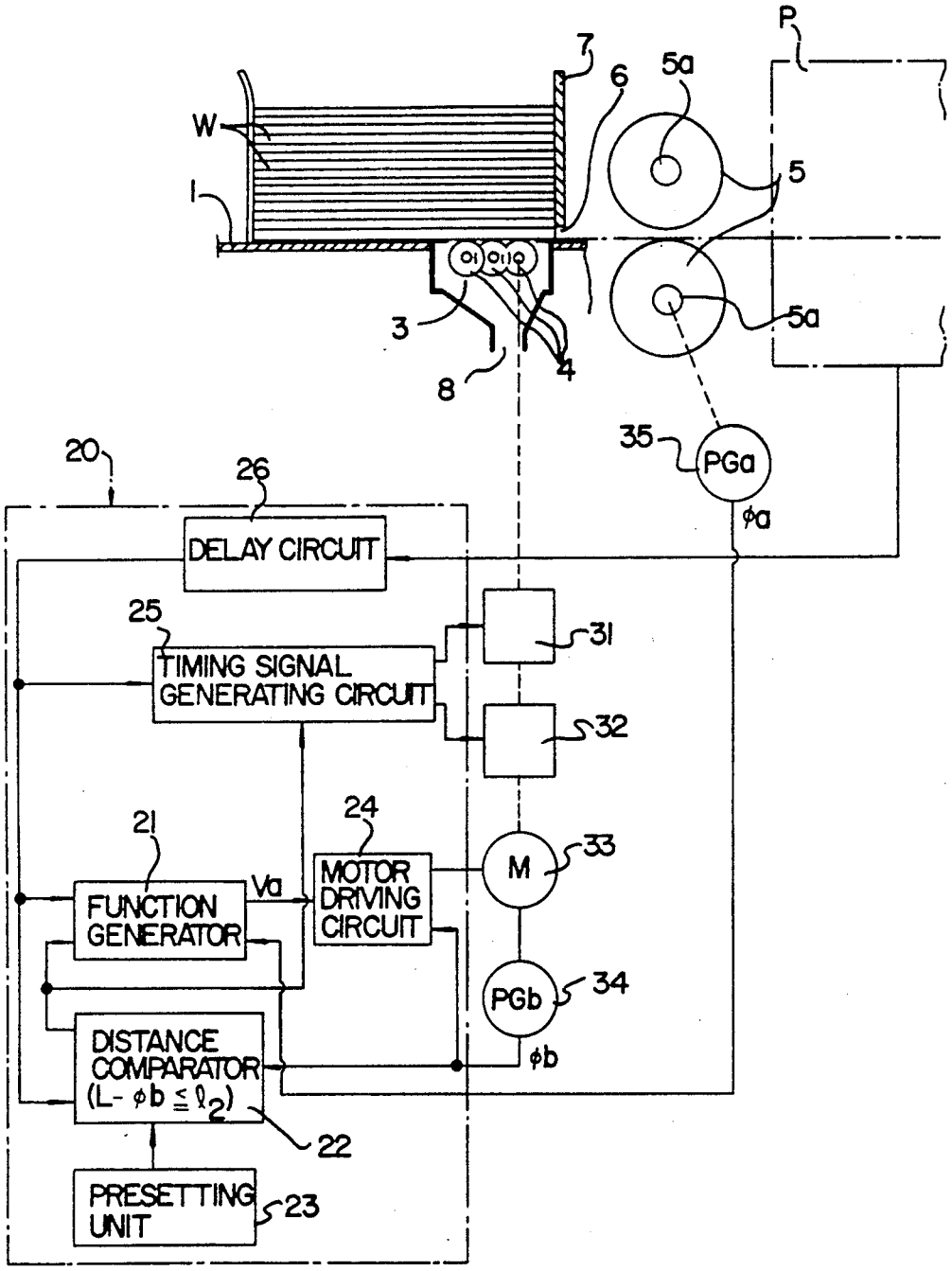
FIG. 2 is a block diagram of the electric circuit of the same.

The operation in this embodiment is controlled by an electric control circuit 20 shown in FIG. 2. An external signal generated every cycle in the device P for the next step is fed to a timing signal generating circuit 25 in the control circuit 20. The timing signal turns a brake 31 OFF and a one-way clutch 32 ON so that the transmission from a motor 33 will be in a stand-by state.

The external signal from the device for the next step is applied to the timing signal generating circuit 25 through a delay circuit 26. The latter is necessary in order to adjust the start-up timing of one cycle of the first feed rolls 4 according to the distance between the blank feeder and the next step as well as the driving speed of the next step or the second feed rolls 5.

The external signal is simultaneously given to a function generator 21 through the delay circuit 26. Based upon the external signal, the function generator 21 generates a velocity/voltage signal $V_a$, which increases with time. This change in output is determined by setting the output voltage curve of the function generator 21 so that the value given by time-integrating the velocity curve of the first feed rolls 4 by the time $t_0$–$t_1$ will coincide with the length $l_1$.

A velocity signal $\phi_a$ is always given as a constant revolving speed to the function generator 21 from a pulse generator 35 for detecting the revolving speed of rotary shafts 5*a* of the second feed rolls 5 which are rotating synchronized with the device P for the next step. This input signal $\phi_a$ is compared moment-by-moment with velocity/voltage signal $V_a$ in the function generator 21. While the latter is lower than the former, the speed of the first feed rolls will increase following the velocity curve preset in the function generator 21.

When the velocity/voltage signal $V_a$ reaches its maximum at time $t_1$ and coincides with the velocity signal $\phi_a$, thereafter the output voltage signal $V_a$ will be given as a speed voltage corresponding to the velocity signal $\phi_a$. The motor 33 is driven by the output voltage signal $V_a$ through a motor driving circuit 24, so that the first feed rolls 4 will be rotated synchronized with the revolving speed of the second feed rolls 5.

When the first feed rolls 4 begin to feed blank, the feed distance is measured by the pulse generator 34 in terms of the revolving speed of the motor 33. Its output signal $\phi_b$ is given to a distance comparator 22.

In the comparator 22, the difference between the length L of the blank W shown in FIG. 1, which is preset in a presetting unit 23, and the feed rate $\phi_b$ of the blank W by the first feed rolls 4, i.e. $(L-\phi_b)$ is compared with $l_2$. While $(L-\phi_b)$ is larger than $l_2$, the blank W is fed by the first feed rolls 4 which are synchronized with the second feed rolls 5, because in this state the rear end of the blank has not yet passed the frontmost one of the first feed rolls 4. The rear end of the blank W passes the frontmost roll 4 at time $t_1'$, when the $(L-\phi_b)$ coincides with $l_2$.

Also at time $t_1'$, a signal from the distance comparator 22 is fed to the timing signal generating circuit 25. A signal from this circuit turns the brake 31 ON and the oneway clutch 32 OFF to bring the first feed rolls 4 to a sudden stop. The signal from the distance comparator 22 is simultaneously fed to the function generator 21. Based on this signal, the motor 33 is decelerated sharply by turning the output voltage signal $V_a$ to zero so as to be stopped by time $t_4$ at the latest. Thereafter, the blank W is fed by the second feed rolls 5 at a constant speed.

Every time the device P for the next step operates by one cycle, an external signal which indicates the next cycle is given. A point of time which is a predetermined period after the occurrence of the external signal corresponds to time $t_4$ ($t_0$). At this moment, a signal is fed from the delay circuit 26 to the timing signal generating circuit 25 to release the brake 31 and turn the one-way clutch 32 ON. Thereafter the next control cycle is carried out.

SECOND EMBODIMENT

Now the second embodiment of this invention is described with reference to FIGS. 4–7.

Figure 4:
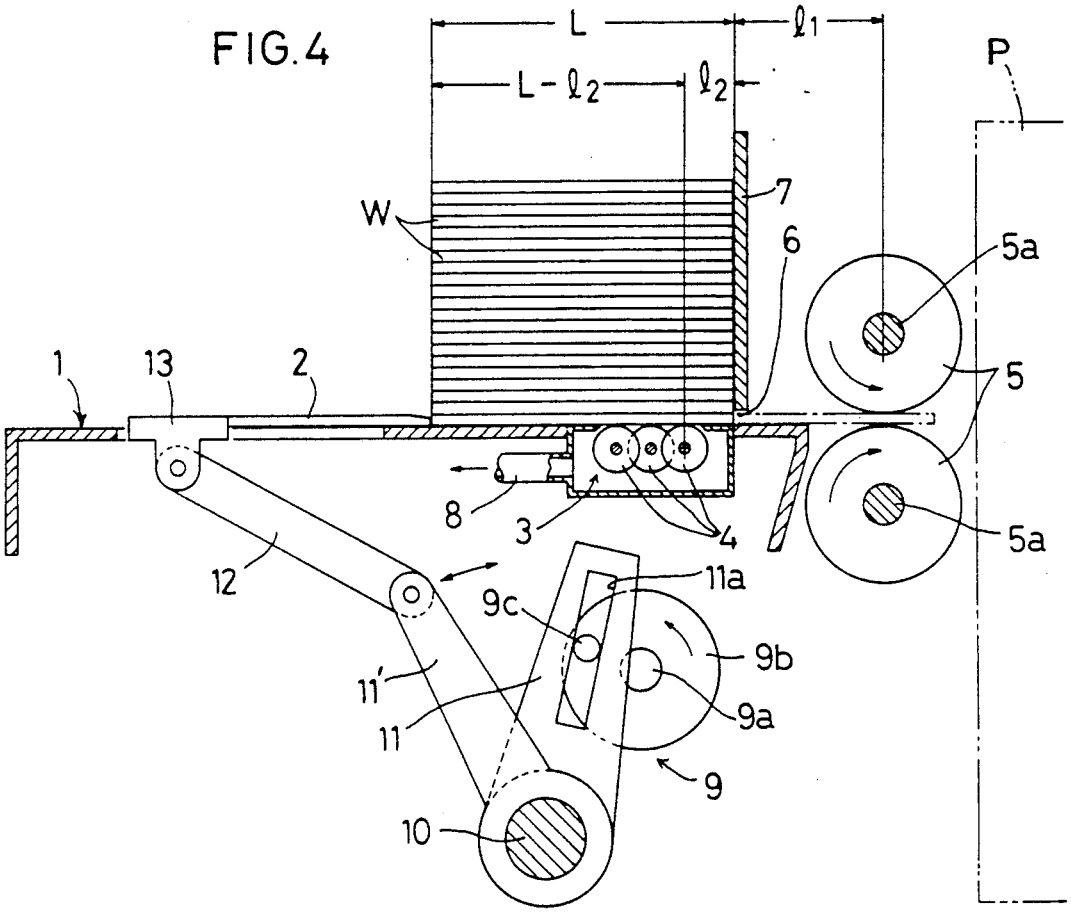
FIG. 4 is a schematic vertical sectional view of the second embodiment.

As shown in FIG. 4, the blank feeder according to this invention comprises a blank feed table 1 for stacking blanks W such as fiberboards thereon, a kicker 2 mounted on the table 1 and adapted to slide horizontally to intermittently push out the blank at the bottom of the stack, a suction unit 3 for pulling the front end portion of the lowermost one of the blanks W downward, first feed rolls 4 mounted in the suction unit 3 and adapted to rotate in contact with the blank W when it is fed out, and second feed rolls 5 for feeding the blank W pushed by the kicker 2 to the next step.

A vertical guide plate 7 is provided at the front end of the blank feed table 1 so as to define a gap 6 between the bottom end of the guide plate 7 and the feed table 1 which is large enough to allow passage of only one blank.

The suction force for pulling the blank W downward is generated in the suction unit 3 by means of a suction blower (not shown) connected to the suction unit 3 through a suction pipe 8. The suction unit 3 has its top almost fully open. The first feed rolls 4 are arranged in the suction unit 3 in a staggered pattern.

The first feed rolls 4 comprise rotary shafts connected through a brake and a clutch to a motor and rolls fixedly mounted on the shafts.

The kicker 2 is coupled with a fast-feed mechanism 9, levers 11 and 11' coupled together into a V-shape by a rotary shaft 10, a link 12 coupled to the lever 11', and a link support 13, so that the kicker 2 can reciprocate horizontally on the blank feed table 1.

The fast-feed mechanism 9 comprises a rotary shaft **9*a*, a rotary disk 9*b* fixedly mounted on the rotary shaft 9*a*, a crank pin 9*c* secured to the disk 9*b* and received in a guide groove 11*a* formed in the lever 11**.

The rotary shafts **9*a* and 10, rotary shafts 5*a* of the second feed rolls 5** and a rotary shaft for rotating a printing cylinder (not shown) in a printing machine P in the next step are all machanically coupled together. Thus the rotary motions of these rotary shafts are all synchronized by a mechanical coupling mechanism.

The operation of this embodiment is described below.

Figure 5:
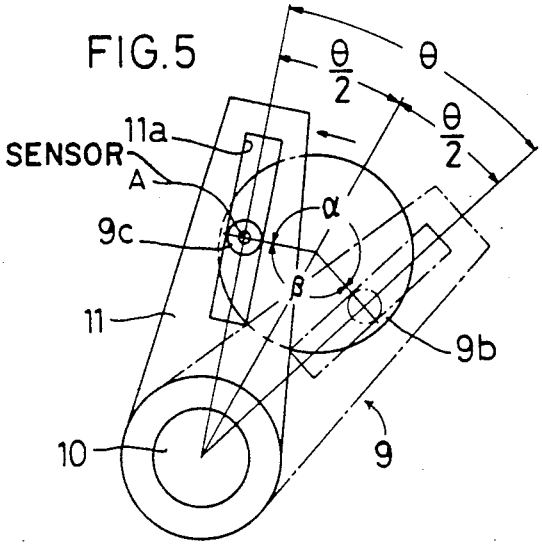
FIG. 5 is an explanatory view of the fast-feed mechanism of the same.

FIG. 5 shows how the fast-feed mechanism reciprocates the kicker 2 horizontally. As is well-known, as the rotary disc **9*b* rotates, the lever 11 will repeat a pivotal motion through an angle $\theta$ by the action of the crank pin 9*c*, which moves through an angle $\beta$ to move the kicker 2 forward and through an angle $\alpha$ to move it backwards. The angle $\alpha$ is larger than the angle $\beta$. The horizontal moving speed of the kicker 2 in the forward direction will reach its maximum when the crank lever 11 has pivoted by an angle $\theta/2$ (or the pin 9*c* has moved by an angle $\beta/2$) (bottom dead point). The horizontal moving speed of the kicker 2 changes as shown in FIG. 3 by the action of the lever 11**.

Figure 7:
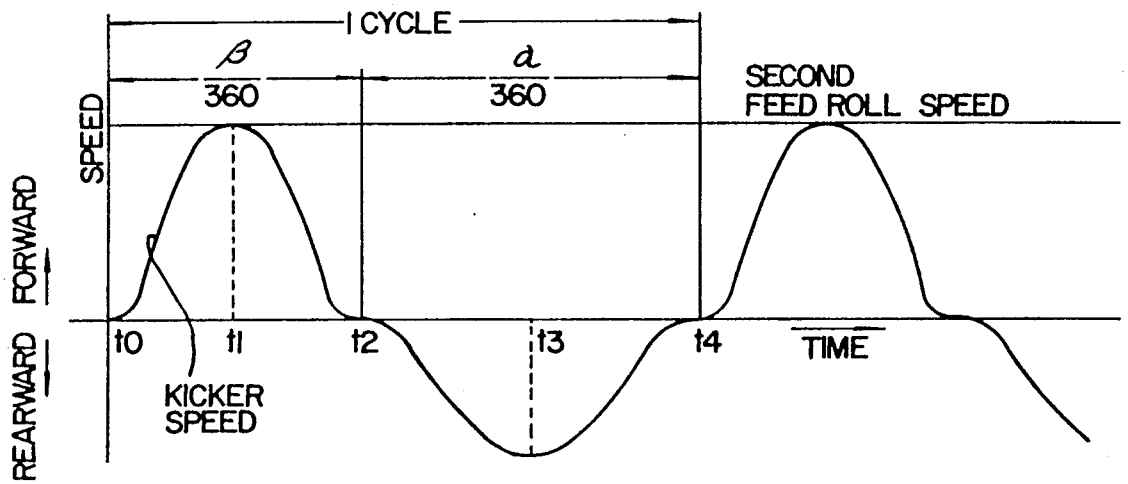
FIG. 7 is an explanatory view of the velocity change of the kicker.

In FIG. 7, $t_0$ designates a point of time where the first feed rolls 4 start rotating. A sensor A is provided to detect this point. As the rotary disc **9*b* rotates in the direction of arrow in FIG. 5, the kicker 2 will be accelerated following the curve shown. At time $t_1$, the front end of the blank W will get caught into between the second feed rolls 5. Thereafter, the blank W will be fed toward the next processing unit e.g. the printing machine P by the second feed rolls 5**.

After time $t_1$, the kicker 2 will begin to slow down gradually, so that it will get off from the rear end of the blank. The kicker 2 changes its moving direction from forward to backward at a point of time ($t_2$) where the crank pin **9*c* has moved by the angle $\beta$ from its starting point. At this point $t_2$, the speed of the kicker 2 becomes zero momentarily. Then the kicker 2 will begin to move backwards. Its backward speed is accelerated until the crank pin 9*c* rotates by the angle $\alpha/2$ and reaches its top dead point (time $t_3$). From time $t_3$ to time $t_4$, the kicker 2** is decelerated. It will regain its original phase angle at time $t_4$, where the kicker changes its moving direction from backward to forward. The same cycle will be repeated thereafter.

The length $l_1$ in FIG. 4 corresponds to the timeintegrated value of the feed speed curve between time $t_0$–$t_1$.

Figure 3:
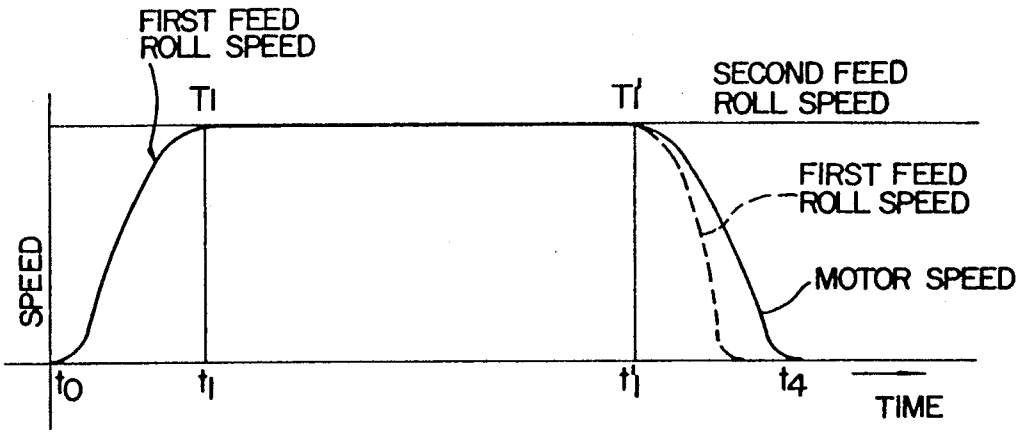
FIG. 3 is an explanatory view of the velocity change of first feed rolls.

It is necessary that the blank feed speed by the kicker 2 be in strict synchronization with the feed speed by the first feed rolls 4 in a period between time $t_0$–$t_1$, as shown in FIG. 3. If the feed speed of the rolls 4 is higher than that of the kicker 2, it would become difficult to feed the blank at an accurate speed. If it is slower, the blank might get bent by the kicker.

Once the blank W is caught between the second feed rolls 5 at time $t_1$, the motor for the rolls 4 is controlled so that the feed speed of the first feed rolls 4 will be synchronized with that of the second feed rolls 5. This synchronized state is maintained at least until the rear end of the blank gets off the frontmost one of the first feed rolls 4. During this period, the blank will move from the distance $l_1$ at time $t_1$ to the distance at $t_1'$ ($L-l_2$: which corresponds to the time-integrated value of the feed speed curve of the first feed rolls in FIG. 3 between time $t_0$ and time $t_1'$).

Time $t_1'$, when the rear end of the blank W passes the frontmost one of the first feed rolls 4, is detected by an electric control circuit, which is to be described below. The moment the time $t_1'$ is detected, the one-way clutch will be switched OFF and the brake ON to bring the first feed rolls 4 to a sudden stop. The motor is stopped at latest by time $t_4$.

When the crank pin 9C of the rotary disc 9*b* reaches the time $t_4(t_0)$, the one-way clutch will be turned ON again by the signal from the sensor A, releasing the brake. Thus the above-described cycle will be repeated.

In this embodiment, the blank feed action by the first feed rolls 4 is stopped by use of the one-way clutch and the brake. But the rolls 4 may be lowered at time $t_1'$ instead of using the clutch and the brake. In such a case, the rolls 4 are raised at time $t_4$ ($t_0$).

With the arrangement of the second embodiment, in contrast with the device having only a kicker, the blanks can be fed without interruption because they are less likely to warp or bend. Also, in contrast with the device having only a suction unit and first feed rolls, no slip will occur and thus no deviation in the blank feed timing will happen.

Figure 6:
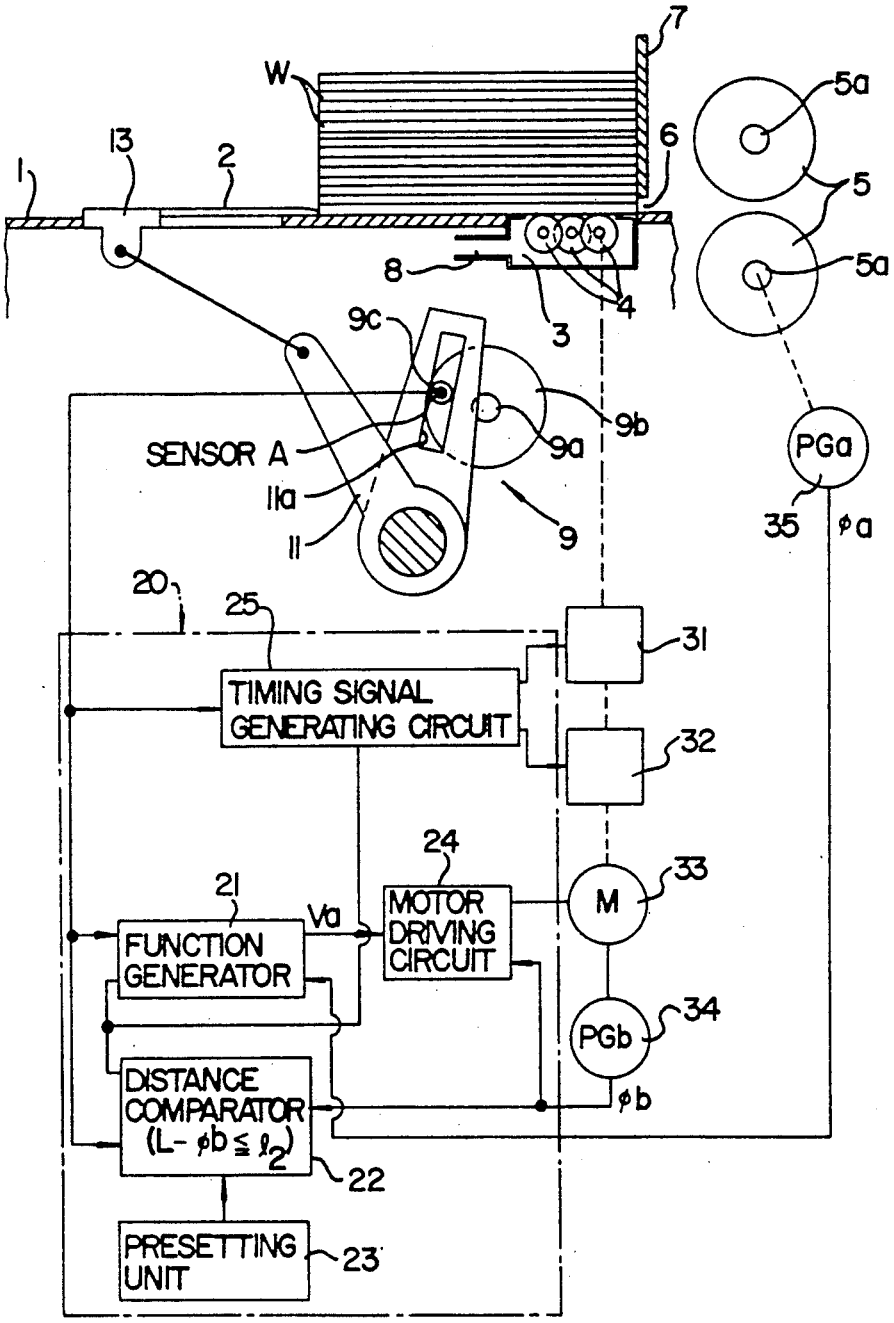
FIG. 6 is a block diagram of the electric circuit of the same.
Figure 8A:
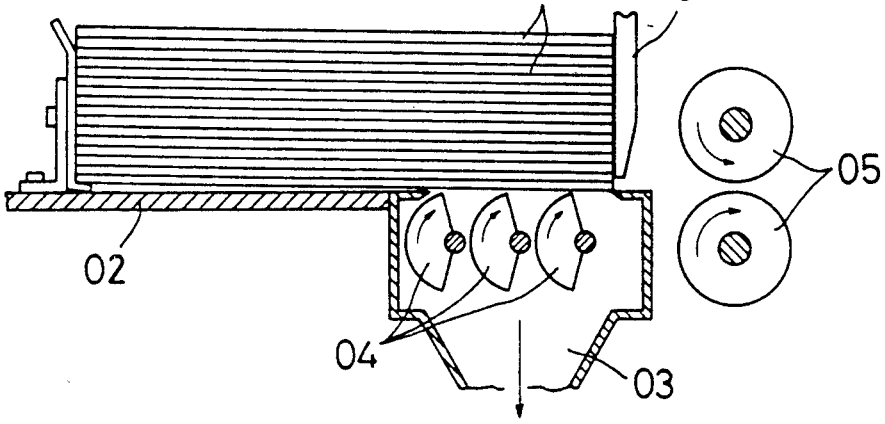
PRIOR ART FIG.8A
FIGS. 8A to 8D are schematic views of a prior art blank feeder.
Figure 8B:
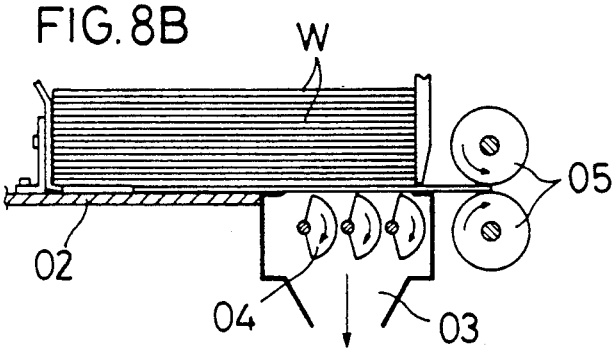
Figure 8C:
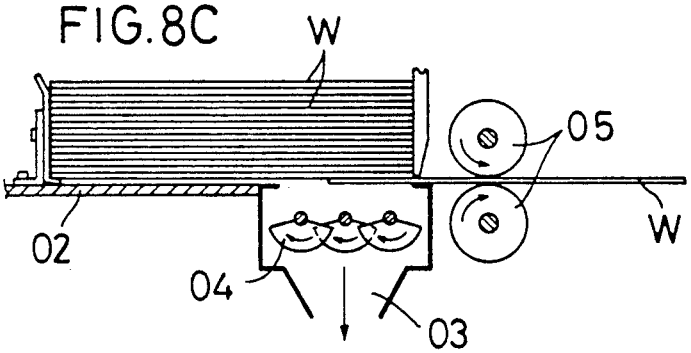
Figure 8D:
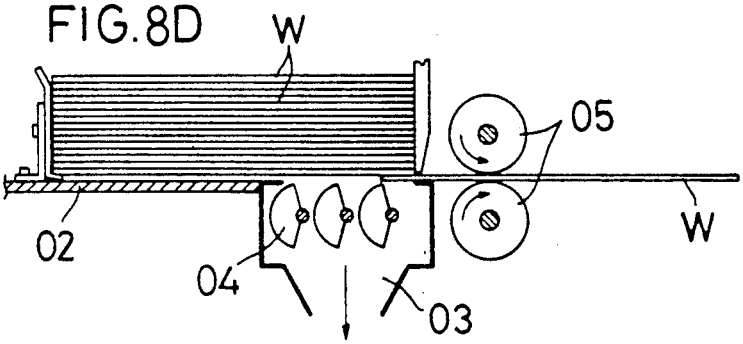

The operation of this embodiment is controlled by means of an electric control circuit 20 shown in FIG. 6. When the control circuit 20 detects a signal from the sensor A which indicates the starting point (corresponding to time $t_0$) of one cycle of the crank pin 9*c* in the fast-feed mechanism 9, a signal is given from a timing signal generating circuit 25 to switch a brake 31 OFF and a one-way clutch 32 ON so as to permit the first feed rolls 4 to be driven by a motor 33.

The signal from the sensor A is applied to a function generator 21, too. A velocity signal $\phi_2$ is applied as a constant rotating speed to the function generator 21 from a pulse generator 35 for detecting the rotating speed of the rotary shafts 5*a* of the second feed rolls 5 mechanically coupled with the rotary shaft 9*a* of the rotary disc 9*b*. The function generator 21 generates a velocity-voltage signal Va corresponding to the forward accelerating velocity curve, which is a velocity curve mechanically inherent to the kicker 2 and determined by the velocity signal $\phi_2$ thus inputted. This signal $V_a$ is given to a motor driving circuit 24 to drive the motor 33.

The velocity curve representing the velocity-voltage signal Va generated by the function generator 21 reaches its maximum at time $t_1$. At that time, the rotating speed of the first feed rolls 4, which are driven based on the velocity-voltage signal Va, will be equal to the rotating speed of the second feed rolls 5, which rotate based on the velocity signal $\phi_2$. After time $t_1$, the function generator 21 outputs a velocity-voltage signal corresponding to the velocity signal $\phi_2$ for the second feed rolls 5, so that the motor 33 for the first feed rolls 4 will be driven synchronized with the rotating speed of the second feed rolls 5.

When the kicker 2 and the first feed rolls 4 begin to feed the blank, the distance of travel thereof will be measured by a pulse generator 34 in terms of the number of revolutions of the motor 33. Its output signal $\phi_b$ will be applied to a distance comparator 22.

In the comparator 22, the blank feed rate $\phi_b$ by the first feed rolls 4 is subtracted from the length L of the blank W, which is preset by a presetting unit 23. The difference $(L-\phi_b)$ is then compared with the value $l_2$. While $(L-\phi_b)$ is larger than $l_2$, the first feed rolls 4 are kept synchronized with the second feed rolls 5 to keep feeding the blank W because its rear end has not cleared the frontmost roll 4. When $(L-\phi_b)$ becomes equal to $l_2$, or at time $t_1'$, the rear end of the blank will clear the frontmost one of the rolls 4.

At time $t_1'$ a signal will be given from the distance comparator 22 to the timing signal generating circuit 25, which in turn gives a signal to turn the brake 31 ON and the one-way clutch 32 OFF. The rolls 4 will be thus stopped abruptly. The signal from the distance comparator 22 is also fed to the function generator 21, which, in response to this signal, turns the output voltage signal Va to zero and decelerates the motor 33 rapidly to stop it by the time $t_4$ at the latest. After time $t_1'$, too, the blank W is fed at a constant speed by the second feed rolls 5.

Time $t_4$ ($t_0$) corresponds to the moment when the rotary disc 9*b* of the fast-feed mechanism 9 makes one full turn and the position of its crank pin 9*c* is detected again by the sensor A. The detection signal of the sensor A is fed to the timing signal generating circuit 25 to release the brake 31 and turn the one-way clutch 32 ON. Then the above-described cycle will be repeated.

What is claimed is:

1. A method for controlling a blank feeder including a blank feed table upon which blanks such as corrugated fiberboards are stacked, suction means provided under said blank feed table for sucking the lowermost one of said blanks downward, first feed rolls mounted in said suction means for feeding said blanks, a vertical guide plate located at the front portion of said blank feed table, second feed rolls located downstream of said vertical guide plate by a distance $l_1$ for delivering said blanks to a next step, comprising the steps of starting said first feed rolls by applying a timing signal thereto which is obtained based on a signal which represents one cycle, so as to intermittently feed said blanks one at a time through a gap defined by said blank feed table and said vertical guide plate, accelerating said first feed rolls to the speed of said second feed rolls by the time when the front end of said each blank reaches said second feed rolls, so that the value obtained by integrating the speed curve for said first feed rolls from the start of feeding of the blank by said first feed rolls to the time when the front end of the blank has reached said second feed rolls will be equal to $l_1$, and driving said first feed rolls synchronized with said second feed rolls until said blank clears said first feed rolls, by controlling a motor for said first feed rolls, separate from a motor for said second feed rolls.

2. A blank feeder comprising a blank feed table upon which blanks such as corrugated fiberboards are stacked, suction means provided under said blank feed table for sucking the lowermost one of said blanks downward, first feed rolls mounted in said suction means for feeding said blanks, a vertical guide plate located at the front portion of said blank feed table, second feed rolls located downstream of said vertical guide plate for delivering said blanks to a next step, first drive means for driving said first feed rolls, second drive means for driving said second feed rolls at a constant speed, and control means for accelerating said first feed rolls from zero speed to the speed of said second feed rolls by the time the front end of said lowermost blank reaches said second feed rolls, driving said first feed rolls synchronized with said second feed rolls until said blank clears said first feed rolls, and decelerating said first feed rolls to zero speed by the time the next cycle starts.

3. A blank feeder comprising a blank feed table upon which blanks such as corrugated fiberboards are stacked, a kicker for intermittently pushing out the lowermost one of the blanks, suction means provided under said blank feed table for sucking the lowermost blank downwards, first feed rolls mounted in said suction means for feeding said blanks, a vertical guide plate located at the front portion of said blank feed table, second feed rolls located downstream of said vertical guide plate for delivering the blanks to a next step, and means for accelerating said kicker and said first feed rolls to the rotating speed of said second feed rolls while keeping said kicker and said first feed rolls synchronized with each other, until the rear end of said lowermost blank clears said first feed rolls.

* * * * *